US006805221B1

(12) United States Patent
Lee

(10) Patent No.: US 6,805,221 B1
(45) Date of Patent: Oct. 19, 2004

(54) LADDER POSITIONING SYSTEM

(76) Inventor: Howard Lee, 331 Feasby Road, R.R. 1, Uxbridge, ON (CA), L9P 1R1

( * ) Notice: Subject to any disclaimer, the term of this patent is extended or adjusted under 35 U.S.C. 154(b) by 0 days.

(21) Appl. No.: 10/392,073

(22) Filed: Mar. 19, 2003

(51) Int. Cl.[7] ..... E04G 5/02; E06C 7/14; E06C 7/06

(52) U.S. Cl. ..... 182/107; 182/214; 248/210

(58) Field of Search ..... 248/201, 200, 248/300, 210, 238; 119/770; 182/107, 214, 108, 206, 3, 36, 38, 39

(56) References Cited

U.S. PATENT DOCUMENTS 1,354,166 A * 9/1920 Busko ..... 182/108
2,014,141 A * 9/1935 Lithgow ..... 182/108
3,903,991 A * 9/1975 Phelan ..... 248/210
5,012,895 A * 5/1991 Santos ..... 182/107
5,311,966 A * 5/1994 Daniels ..... 182/128
5,361,866 A * 11/1994 Bell et al. ..... 182/3
5,462,133 A * 10/1995 Merrill et al. ..... 182/172
5,788,198 A * 8/1998 Sharpe ..... 248/210
6,029,774 A * 2/2000 Cothern ..... 182/107
6,427,803 B1 * 8/2002 Moore ..... 182/107
6,520,290 B1 * 2/2003 Carter ..... 182/3

* cited by examiner

*Primary Examiner*—Hugh B. Thompson, II
(74) *Attorney, Agent, or Firm*—Edward P. Dutkiewicz

(57) ABSTRACT

A ladder has side rails with rungs and lower eye-bolts extending from the side rails. A bracket is couplable to a building to be painted or maintained with upper eye-bolts. A pair of turnbuckles have central sections, upper end sections and lower end sections. A pair of J-shaped hooks have lower ends. The lower ends are coupled to the upper ends of the turnbuckle. An upper hook-shaped end is removably coupled to an upper eye-bolt. A pair of short chains has upper ends threadedly coupled to the lower end of the turnbuckle. A lower hook-shaped end is removably coupled to a lower eye-bolt.

7 Claims, 7 Drawing Sheets

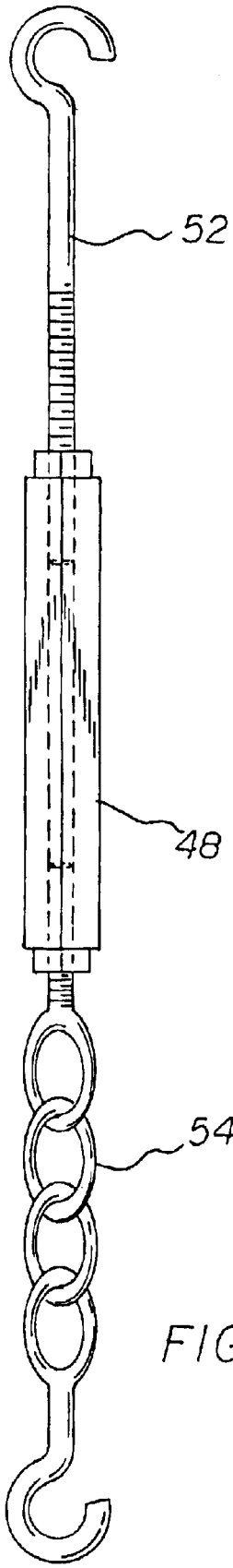
FIG 5
FIG 4
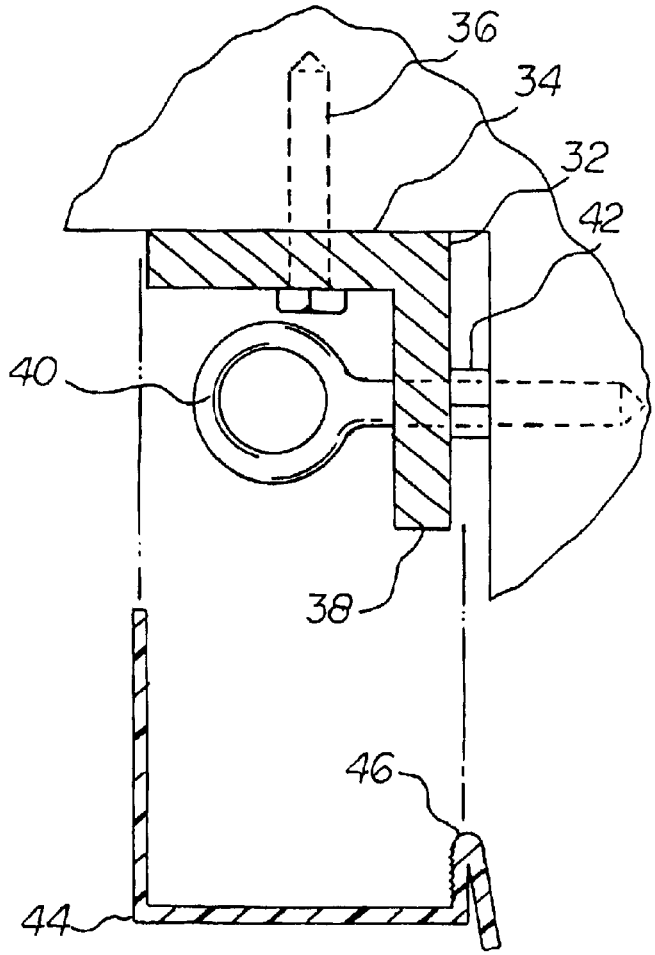

LADDER POSITIONING SYSTEM

BACKGROUND OF THE INVENTION

1. Field of the Invention

The present invention relates to a ladder positioning system and more particularly pertains to safely and efficiently supporting a user while painting or maintaining a building.

2. Description of the Prior Art

The use of ladder positioners of known designs and configurations is known in the prior art. More specifically, ladder positioners of known designs and configurations previously devised and utilized for the purpose of supporting painters through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,899,847 to Lufkin relates to mobile supports. U.S. Pat. No. 4,039,047 to Larson relates to ladders incorporating retractable ground spikes. U.S. Pat. No. 5,255,757 to Horowitz relates to a collapsible ladder. U.S. Pat. No. 5,960,906 to Henderson relates to a movable ladder support assembly. U.S. Pat. No. 3,340,960 to Wilson relates to a ladder. U.S. Pat. No. 4,401,184 to Sherry relates to a roof skid. U.S. Pat. No. 1,160,721 to Kessler relates to a roof ladder. U.S. Pat. No. 294,319 to Hofele relates to a folding fire escape ladder. U.S. Pat. No. 907,401 Prouty relates to a ladder. Lastly, U.S. Pat. No. 4,232,759 to Jacobs relates to a mobile ladder-scaffolding system.

While these devices fulfill their respective, particular objectives and requirements, the aforementioned patents do not describe a ladder positioning system that allows safely and efficiently supporting and protecting a user from falls or injury while painting or maintaining a building.

In this respect, the ladder positioning system according to the present invention substantially departs from the conventional concepts and designs of the prior art, and in doing so provides an apparatus primarily developed for the purpose of safely and efficiently supporting a user while painting or maintaining a building.

Therefore, it can be appreciated that there exists a continuing need for a new and improved ladder positioning system which can be used for safely and efficiently supporting a user while painting or maintaining a building. In this regard, the present invention substantially fulfills this need.

SUMMARY OF THE INVENTION

In view of the foregoing disadvantages inherent in the known types of ladder positioners of known designs and configurations now present in the prior art, the present invention provides an improved ladder positioning system. As such, the general purpose of the present invention, which will be described subsequently in greater detail, is to provide a new and improved ladder positioning system and method which has all the advantages of the prior art and none of the disadvantages.

To attain this, the present invention essentially comprises a ladder. The ladder has generally vertically positionable elongated parallel side rails. The runs connect the side rails. The side rails have pairs of lower eye-bolts. The lower eye-bolts extend outwardly from the side rails. The lower eye-bolts extend laterally aligned with the rungs. The lower eye-bolts are adjacent to most of the rungs at the upper extent of the ladder. The ladder and the side rails have an upper end and a lower end. An intermediate extent is provided between the upper and lower ends.

End caps are provided. The end caps are removably positionable over the lower ends of the side rails. Each end cap and the lower end of each side rail have aligned horizontal apertures. A removable pin is provided for securement purposes. Each end cap also has a stake. The stake extends downwardly. In this manner lateral slippage of the end caps, side rails and ladder is abated. The end cap may also be configured to have a rubber based foot for using with the ladder when on flat, hard surfaces.

Provided next is an inverted L-shaped bracket. The L-shaped bracket is couplable at an essentially common height to a building to be painted or maintained. The L-shaped bracket has an upper plate. Bolts are provided through the plate. The bolts are attachable to an upper extent of a building to be painted or maintained. The L-shaped bracket has a lower vertical section. The lower vertical section has upper eye-bolts. The upper eye-bolts are attachable to a horizontal extent of a building to be painted or maintained. A spacer is provided. The spacer creates a space between the vertical section and a horizontal extent.

An L-shaped cover is provided next. The L-shaped cover has an upstanding resilient finger. The upstanding resilient finger is removably positionable in the space between the vertical section of the L-shaped bracket. The L-shaped cover has a horizontal extent and a vertical extent. In this manner the inverted L-shaped bracket and upper eye-bolts may be covered when not in use. In this same manner the inverted L-shaped bracket and upper eye-bolts may be exposed when in use.

A pair of turnbuckles is provided next. Each turnbuckle has a central section. The central section is of a variable length. Each turnbuckle also has an upper end section and a lower end section. A pair of J-shaped hook is provided. Each J-shaped hook has a lower end. The lower end is threadedly coupled to the upper end of the turnbuckle. Each J-shaped hook has an upper hook-shaped end. The upper hook-shaped end is removably coupled to an upper eye-bolt. A pair of short chains is provided. Each short chain has an upper end. The upper end is threadedly coupled to the lower end of the turnbuckle. Each short chain has a lower hook-shaped end. The lower hook-shaped end is removably coupled to a lower eye-bolt. In this manner the ladder may be secured to a building during use.

Also provided is a strap. The strap has a central section. The central section is positionable around the back of a user. The strap also has opposed ends. The opposed ends have hooks. The hooks are removably coupled to a pair of lower eye-bolts above the pair of lower eye-bolts coupled to the turnbuckles. In this manner a user may be secured to the ladder during use.

Further provided is a pair of asymmetrical turnbuckles. The asymmetrical turnbuckles are for use in painting or maintaining a building when the inverted L-shaped brackets have associated upper eye-bolts at varying heights such as at an end of a house. Each asymmetrical turnbuckle has a central section of a variable length and an upper end section and a lower end section. A pair of alternate J-shaped hooks is provided. One alternate J-shaped hook 66 is elongated and one alternate J-shaped hook is not elongated. Each alternate J-shaped hook has a lower end. The lower end is threadedly coupled to the upper end of the asymmetrical turnbuckle. An upper hook-shaped end is provided. The upper hook-shaped end is removably coupled to an upper eye-bolt. A pair of short chains is provided. Each short chain has an upper end. The upper end is threadedly coupled to the lower end of the asymmetrical turnbuckle. A lower hook-shaped end is removably coupled to a lower eye-bolt. In this manner the ladder may be secured to a building during use.

Provided last is a horizontal rail. The horizontal rail is securable to an upper extent of a building to be painted or maintained. The horizontal rail is secured with a coupler assembly. The coupler assembly is removably joining the ladder to the rail. The coupler assembly has an upper section. The upper section has rotatable wheels. The rotatable wheels ride in the rail for shifting the ladder during use. Alignable apertures are provided. The alignable apertures extend through the wheels and rail. A pin is provided. The pin is removably received within the alignable apertures. The coupler assembly has a lower section. The lower section has a pivotal clamp. The pivotal claim provides for the removable securement to a rung of the ladder. A hinge is provided between the upper and lower sections. In this manner limited tipping of the ladder and height adjusting turnbuckle between the pivotal clamp and the hinge is allowed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ladder positioning system which has all of the advantages of the prior art ladder positioners of known designs and configurations and none of the disadvantages.

It is another object of the present invention to provide a new and improved ladder positioning system which may be easily and efficiently manufactured and marketed.

It is further an object of the present invention to provide a new and improved ladder positioning system which is of durable and reliable constructions.

An even further object of the present invention is to provide a new and improved ladder positioning system which is susceptible of a low cost of manufacture with regard to both materials and labor, and which accordingly is then susceptible of low prices of sale to the consuming public, thereby making such ladder positioning system economically available to the buying public.

Even still another object of the present invention is to provide a ladder positioning system for safely and efficiently supporting a user while painting or maintaining a building.

Lastly, it is an object of the present invention to provide a new and improved ladder positioning system. A ladder has side rails with rungs and lower eye-bolts extending from the side rails. A bracket is couplable to a building to be painted or maintained with upper eye-bolts. A pair of turnbuckles have central sections, upper end sections and lower end sections. A pair of J-shaped hooks have lower ends. The lower ends are coupled to the upper ends of the turnbuckle. An upper hook-shaped end is removably coupled to an upper eye-bolt. A pair of short chains has upper ends threadedly coupled to the lower end of the turnbuckle. A lower hook-shaped end is removably coupled to a lower eye-bolt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an enlarged view of the turnbuckle-receiving components taken at circle 4 of FIG. 3.

FIG. 5 is an enlarged view of the turnbuckle and associated chain and hook shown in FIGS. 1 and 3.

The same reference numerals refer to the same parts throughout the various Figures.

DESCRIPTION OF THE PREFERRED EMBODIMENT

Figures 1, 2:
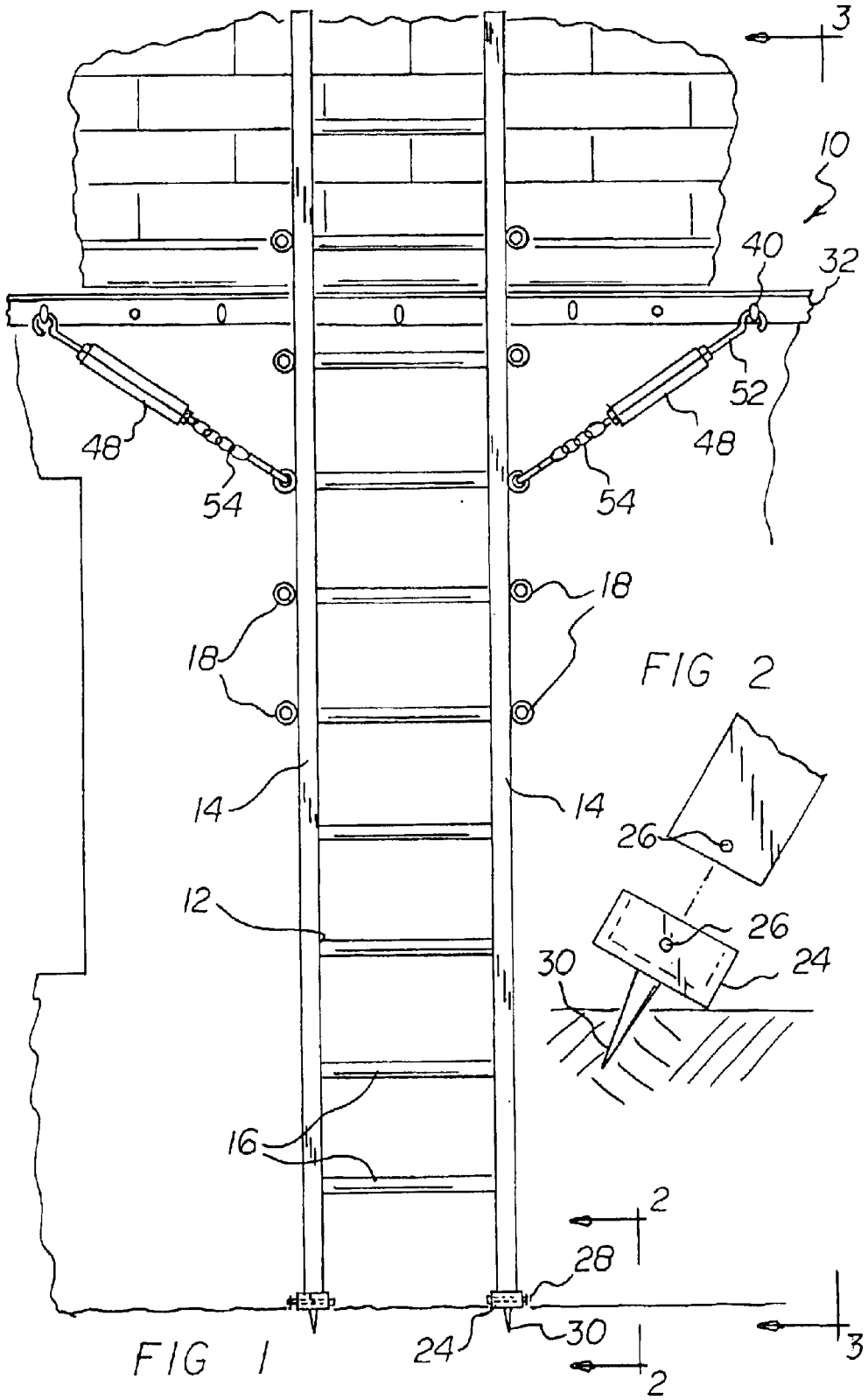
FIG. 1 is a front elevational view of a ladder positioning system coupled to the front of a building, the system being constructed in accordance with the principles of the present invention.
FIG. 2 is an exploded side elevational view of the lower part of the ladder taken at line 2—2 of FIG. 1.
Figure 3:
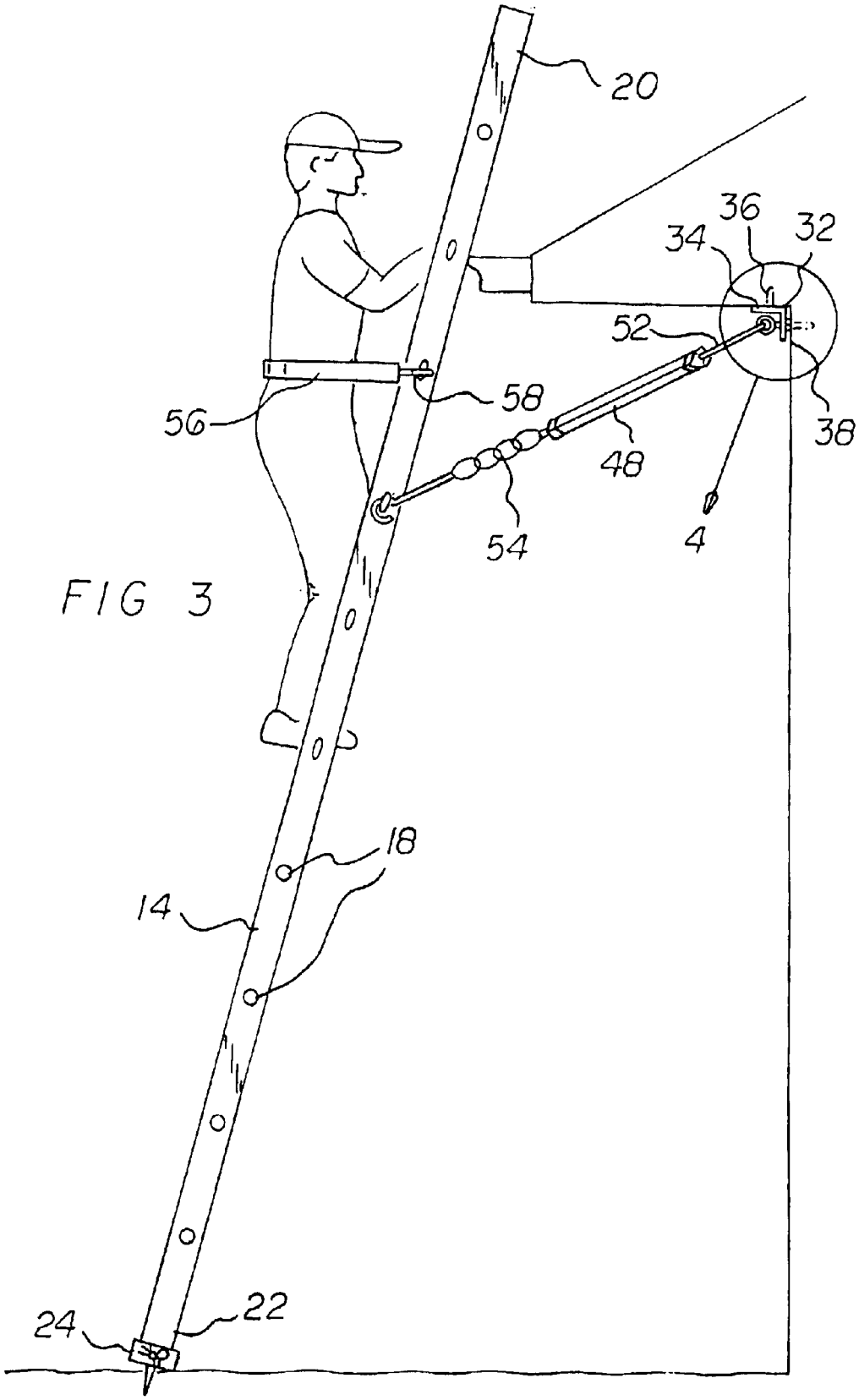
FIG. 3 is a side elevational view of the system taken at line 3—3 of FIG. 1.
Figure 6:
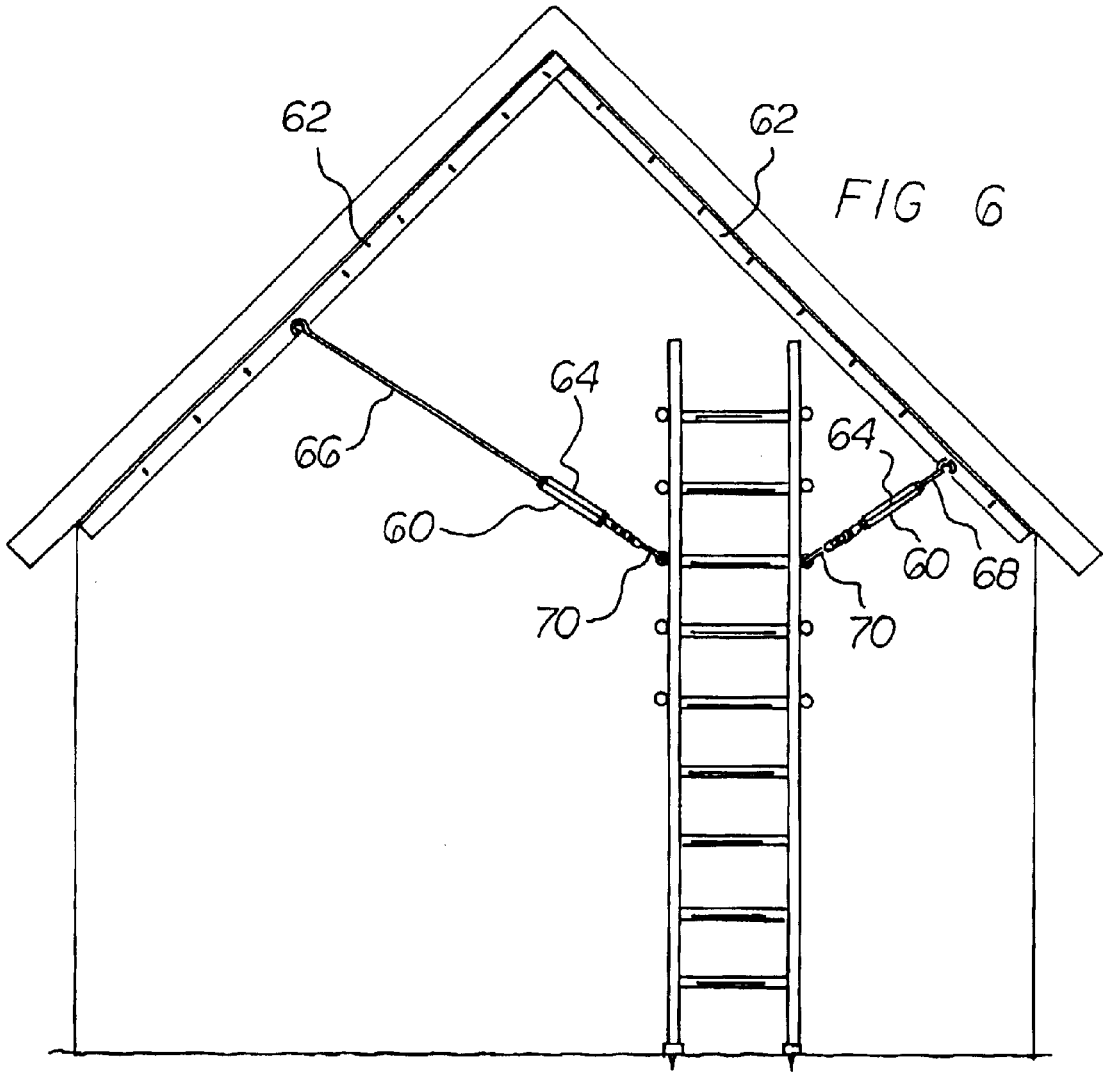
FIG. 6 is a front elevational view of the ladder positioning system but with an extending hook for coupling to an end of a building.
Figure 7:
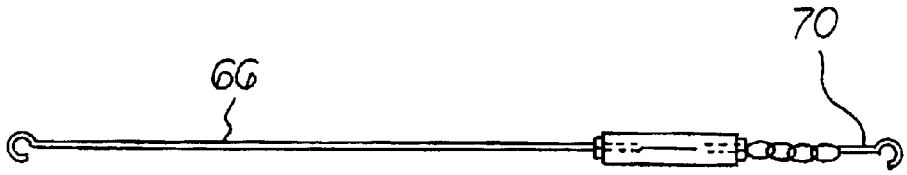
FIG. 7 is an enlarged view of the turnbuckle and associated chain and hook and associated extending hook shown in FIG. 6.
Figure 8:
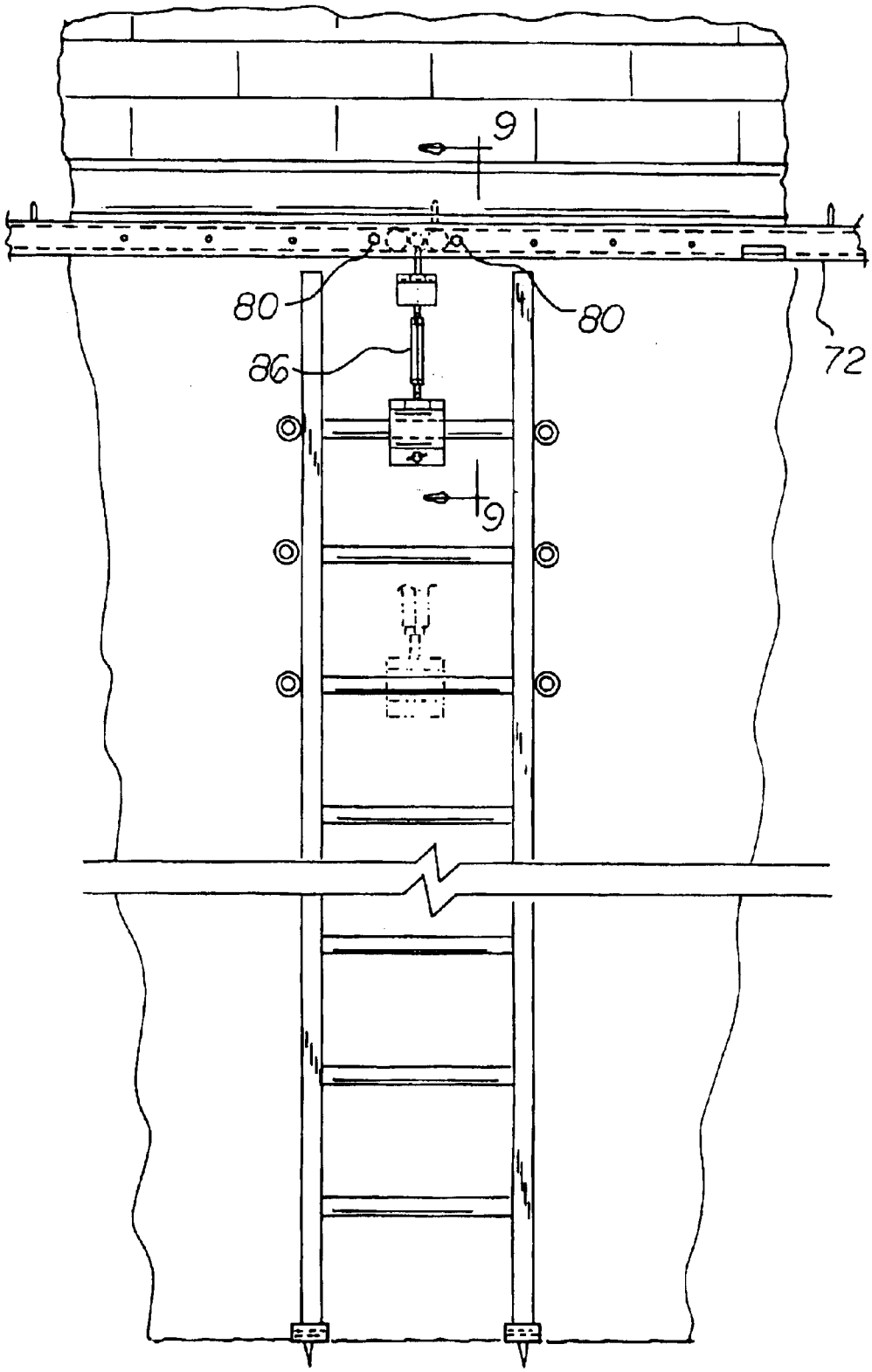
FIG. 8 is a front elevational view of the ladder positioning system similar to FIG. 1 but constructed in accordance with an alternate component, the system being constructed for use when painting or maintaining taller buildings or as an alternate embodiment of the invention.
Figure 9:
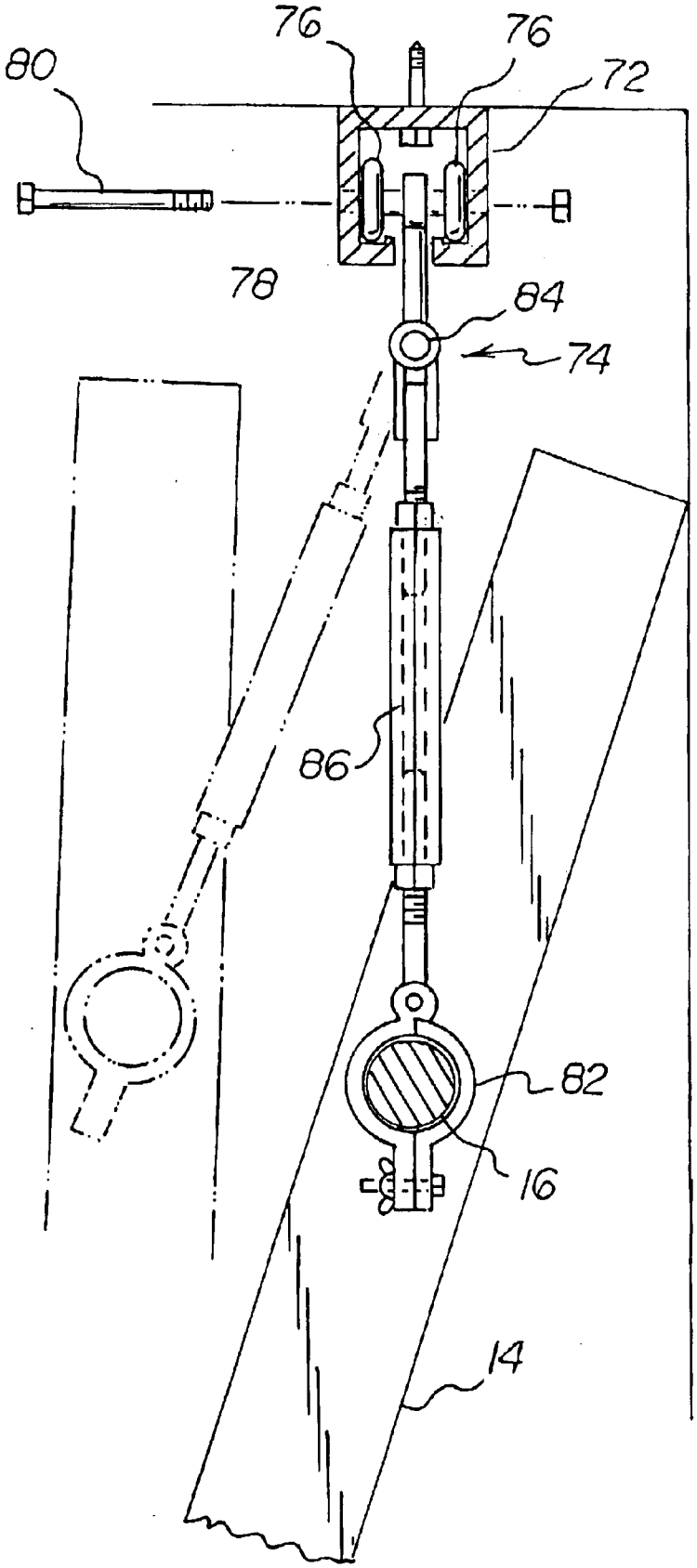
FIG. 9 is a cross sectional view of a portion of the system taken at line 9—9 of FIG. 8.
Figures 10, 11:
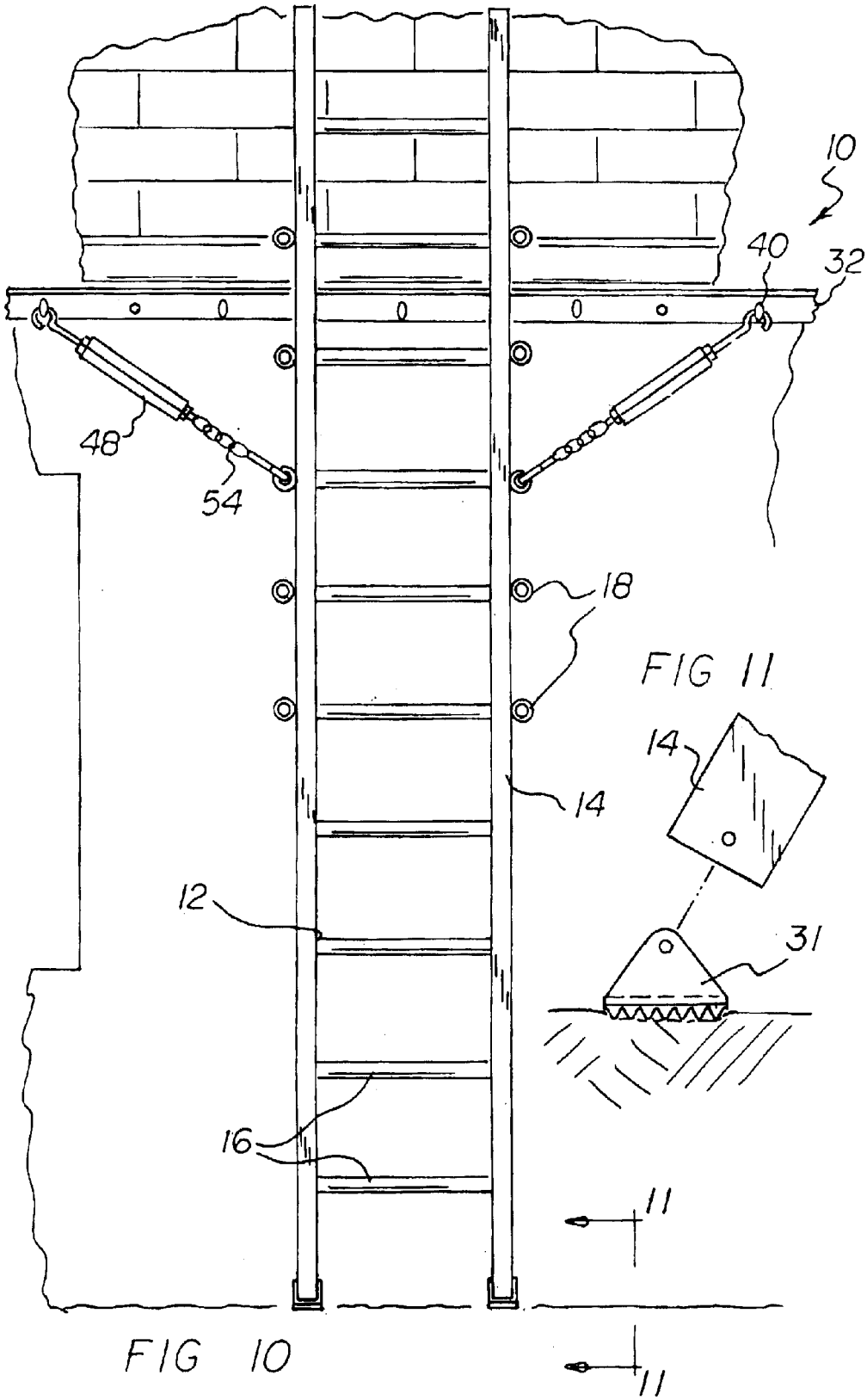
FIG. 10 is a front elevational view of a ladder positioning system coupled to the front of a building, the system being constructed in accordance with the principles of the present invention.
FIG. 11 is an exploded side elevational view of the lower part of the ladder taken at line 11—11 of FIG. 10.

With reference now to the drawings, and in particular to FIG. 1 thereof, the preferred embodiment of the new and improved ladder positioning system embodying the principles and concepts of the present invention and generally designated by the reference numeral 10 will be described.

The present invention, the ladder positioning system 10 is comprised of a plurality of components. Such components in their broadest context include a ladder, a bracket and a pair of turnbuckles. Such components are individually configured and correlated with respect to each other so as to attain the desired objective.

First provided is a ladder 12. The ladder has generally vertically positionable elongated parallel side rails 14. The rungs connect the side rails. The side rails have pairs of lower eye-bolts 18. The lower eye-bolts extend outwardly from the side rails. The lower eye-bolts extend laterally aligned with the rungs. The lower eye-bolts are adjacent to most of the rungs at the upper extent of the ladder. The ladder and the side rails have an upper end 20 and a lower end 22. An intermediate extent is provided between the upper and lower ends.

End caps 24 are provided. The end caps are removably positionable over the lower ends of the side rails. Each end cap and the lower end of each side rail have aligned horizontal apertures 26. A removable pin 28 is provided for securement purposes. Each end cap also has a stake 30. The stake extends downwardly. In this manner lateral slippage of the end caps, side rails and ladder is abated. In an alternative configuration an end cap with a elastomeric pad 31 may be used when the ladder is employed on a flat hard surface, such as a driveway.

Provided next is an inverted L-shaped bracket 32. The L-shaped bracket is couplable at an essentially common height to a building to be painted. The L-shaped bracket has an upper plate 34. Bolts 36 are provided through the plate. The bolts are attachable to an upper extent of a building to be painted. The L-shaped bracket has a lower vertical section 38. The lower vertical section has upper eye-bolts 40. The upper eye-bolts are attachable to a horizontal extent of a building to be painted. A spacer 42 is provided. The spacer creates a space between the vertical section and a horizontal extent.

An L-shaped cover 44 is provided next. The L-shaped cover has an upstanding resilient finger 46. The upstanding resilient finger is removably positionable in the space between the vertical section of the L-shaped bracket. The L-shaped cover has a horizontal extent and a vertical extent. In this manner the inverted L-shaped bracket and upper eye-bolts may be covered when not in use. In this same manner the inverted L-shaped bracket and upper eye-bolts may be exposed when in use.

A pair of turnbuckles 48 is provided next. Each turnbuckle has a central section 50. The central section is of a variable length. Each turnbuckle also has an upper end section and a lower end section. A pair of J-shaped hooks 52 is provided. Each J-shaped hook has a lower end. The lower end is threadedly coupled to the upper end of the turnbuckle. Each J-shaped hook has an upper hook-shaped end. The upper hook-shaped end is removably coupled to an upper eye-bolt. A pair of short chains 54 is provided. Each short chain has an upper end. The upper end is threadedly coupled to the lower end of the turnbuckle. Each short chain has a lower hook-shaped end. The lower hook-shaped end is removably coupled to a lower eye-bolt. In this manner the ladder may be secured to a building during use.

Also provided is a strap 56. The strap has a central section. The central section is positionable around the back of a user. The strap also has opposed ends. The opposed ends have hooks 58. The hooks are removably coupled to a pair of lower eye-bolts above the pair of lower eye-bolts coupled to the turnbuckles. In this manner a user may be secured to the ladder during use.

Further provided is a pair of asymmetrical turnbuckles 60. The asymmetrical turnbuckles are for use in painting or maintaining a building when the inverted L-shaped brackets 62 have associated upper eye-bolts at varying heights such as at an end of a house. Each asymmetrical turnbuckle has a central section 64 of a variable length and an upper end section and a lower end section. A pair of alternate J-shaped hooks 66, 68 is provided. One alternate J-shaped hook 66 is elongated and one alternate J-shaped hook 68 is unelongated. Each alternate J-shaped hook has a lower end. The lower end is threadedly coupled to the upper end of the asymmetrical turnbuckle. An upper hook-shaped end is provided. The upper hook-shaped end is removably coupled to an upper eye-bolt. A pair of short chains 70 is provided. Each short chain has an upper end. The upper end is threadedly coupled to the lower end of the asymmetrical turnbuckle. A lower hook-shaped end is removably coupled to a lower eye-bolt. In this manner the ladder may be secured to a building during use.

Provided last is a horizontal rail 72. The horizontal rail is securable to an upper extent of a building to be painted or maintained. The horizontal rail is secured with a coupler assembly 74. The coupler assembly is removably joining the ladder to the rail. The coupler assembly has an upper section. The upper section has rotatable wheels 76. The rotatable wheels ride in the rail for shifting the ladder during use. Alignable apertures 78 are provided. The alienable apertures extend through the wheels and rail. A pin 80 is provided. The pin is removably received within the alignable apertures. The coupler assembly has a lower section. The lower section has a pivotal clamp 82. The pivotal claim provides for the removable securement to a rung of the ladder. A hinge 84 is provided between the upper and lower sections. In this manner limited tipping of the ladder and height adjusting turnbuckle between the pivotal clamp and the hinge is allowed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder positioning system for safely and efficiently supporting a user while maintaining a building comprising, in combination:

a ladder having generally vertically positionable elongated parallel side rails with horizontally positionable spaced rungs there between connecting the side rails, the side rails having pairs of lower eye-bolts extending outwardly from the side rails laterally aligned with the rungs adjacent to most of the rungs at the upper extent of the ladder, the ladder and the side rails having an upper end and a lower end and an intermediate extent there between;

end caps removably positionable over the lower ends of the side rails, each end cap and the lower end of each side rail having aligned horizontal apertures with a removable pin for securement purposes, each end cap also having a stake extending downwardly to abate lateral slippage of the end caps, side rails and ladder;

an inverted L-shaped bracket couplable at an essentially common height to a building to be maintained, the L-shaped bracket having an upper plate with bolts there through attachable to an upper extent of a building to be maintained, the L-shaped bracket having a lower vertical section with upper eye-bolts attachable to a horizontal extent of a building to be maintained with a spacer creating a space between the vertical section and a horizontal extent;

an L-shaped cover with an upstanding resilient finger removably positionable in the space between the vertical section of the L-shaped bracket, the L-shaped cover having a horizontal extent and a vertical extent for covering the inverted L-shaped bracket and upper eye-bolts when not in use and for exposing the inverted L-shaped bracket and upper eye-bolts when in use;

a pair of turnbuckles, each turnbuckle having a central section of a variable length and an upper end section and a lower end section, a pair of J-shaped hooks, each J-shaped hook having a lower end threadedly coupled to the upper end of the turnbuckle and an upper hook-shaped end removably coupled to an upper eye-bolt, a pair of short chains, each short chain having an upper end threadedly coupled to the lower end of the turnbuckle and a lower hook-shaped end removably coupled to a lower eye-bolt for securing the ladder to a building during use;

a strap having a central section positionable around the back of a user, the strap also having opposed ends with hooks, the hooks being removably coupled to a pair of lower eye-bolts above the pair of lower eye-bolts coupled to the turnbuckles for securing a user to the ladder during use;

a pair of asymmetrical turnbuckles for use in maintaining a building when the inverted L-shaped brackets have associated upper eye-bolts at varying heights at an end of a house, each asymmetrical turnbuckle having a central section of a variable length and an upper end section and a lower end section, a pair of alternate J-shaped hooks, one alternate J-shaped hook being elongated and one alternate J-shaped hook being not elongated, each alternate J-shaped hook having a lower end threadedly coupled to the upper end of the asymmetrical turnbuckle and an upper hook-shaped end removably coupled to an upper eye-bolt, a pair of short chains, each short chain having an upper end threadedly coupled to the lower end of the asymmetrical turnbuckle and a lower hook-shaped end removably coupled to a lower eye-bolt for securing the ladder to a building during use; and a horizontal rail securable to an upper extent of a building to be maintained with a coupler assembly removably joining the ladder to the rail, the coupler assembly having an upper section with rotatable wheels riding in the rail for shifting the ladder during use, alignable apertures extending through the wheels and rail and a pin removably received within the alignable apertures, the coupler assembly having a lower section with a with a pivotal clamp for removable securement to a rung of the ladder with a hinge between the upper and lower sections to allow limited tipping of the ladder, and a height adjusting turnbuckle between the pivotal clamp and the hinge.

2. A ladder positioning system comprising:

a ladder having side rails with rungs and lower eye-bolts extending from the side rails;

a bracket couplable to a building to be maintained with upper eye-bolts;

a pair of turnbuckles each having a central section and an upper end section and a lower end section, a pair of J-shaped hooks with each J-shaped hook having a lower end coupled to the upper end of the turnbuckle and an upper hook-shaped end removably coupled to an upper eye-bolt, a pair of short chains with each short chain having an upper end threadedly coupled to the lower end of the turnbuckle and a lower hook-shaped end removably coupled to a lower eye-bolt; and further including an L-shaped cover with an upstanding resilient finger removably positionable adjacent to the bracket, the L-shaped cover having a horizontal extent and a vertical extent for covering the inverted L-shaped bracket and upper eye-bolts when not in use and for exposing the inverted L-shaped bracket and upper eye-bolts when in use.

3. The system as set forth in claim 2 and further including end caps removably positionable over the lower ends of the side rails, each end cap and the lower end of each side rail having aligned horizontal apertures with a removable pin for securement purposes, each end cap also having a stake extending downwardly to abate lateral slippage of the end caps, side rails and ladder.

4. The system as set forth in claim 2 and further including a strap having a central section positionable around the back of a user, the strap also having opposed ends with hooks, the hooks being removably coupled to a pair of lower eye-bolts above the pair of lower eye-bolts coupled to the turnbuckles for securing a user to the ladder during use.

5. The system as set forth in claim 2 and further including a pair of asymmetrical turnbuckles for use in maintaining a building when the inverted L-shaped brackets have associated upper eye-bolts at varying heights at an end of a house, each asymmetrical turnbuckle having a central section of a variable length and an upper end section and a lower end section, a pair of alternate J-shaped hooks, one alternate J-shaped hook being elongated and one alternate J-shaped hook being not elongated, each alternate J-shaped hook having a lower end threadedly coupled to the upper end of the asymmetrical turnbuckle and an upper hook-shaped end removably coupled to an upper eye-bolt, a pair of short chains, each short chain having an upper end threadedly coupled to the lower end of the asymmetrical turnbuckle and a lower hook-shaped end removably coupled to a lower eye-bolt for securing the ladder to a building during use.

6. The system as set forth in claim 2 and further including end caps removably positionable over the lower ends of the side rails, each end cap and the lower end of each side rail having aligned horizontal apertures with a removable pin for securement purposes, each end cap also having an elastomeric pad to prevent slippage of the end caps, side rails and ladder.

7. A ladder positioning system comprising:

a ladder having side rails with rungs and lower eye-bolts extending from the side rails;

a bracket couplable to a building to be maintained with upper eye-bolts;

a pair of turnbuckles each having a central section and an upper end section and a lower end section, a pair of J-shaped hooks with each J-shared hook having a lower end coupled to the upper end of the turnbuckle and an upper hook-shaped end removably coupled to an upper eye-bolt, a pair of short chains with each short chain having an upper end threadedly coupled to the lower end of the turnbuckle and a lower hook-shaped end removably coupled to a lower eve-bolt; and a horizontal rail securable to an upper extent of a building to be maintained with a coupler assembly removably joining the ladder to the rail, the coupler assembly having an upper section with rotatable wheels riding in the rail for shifting the ladder during use, alignable apertures extending through the wheels and rail and a pin removably received within the alignable apertures, the coupler assembly having a lower section with a with a pivotal clamp for removable securement to a rung of the ladder with a hinge between the upper and lower sections to allow limited tipping of the ladder, and a height adjusting turnbuckle between the pivotal clamp and the hinge.

* * * * *